United States Patent [19]

Raymond

[11] Patent Number: 4,635,461

[45] Date of Patent: Jan. 13, 1987

[54] VERITCAL PRESS

[75] Inventor: Roger S. Raymond, Redondo Beach, Calif.

[73] Assignee: Rockwell International Corporation, El Segundo, Calif.

[21] Appl. No.: 663,635

[22] Filed: Oct. 22, 1984

[51] Int. Cl.[4] ..... B21D 37/16; B21D 37/14; B21J 9/10; B21J 13/00

[52] U.S. Cl. ..... 72/342; 72/446; 72/453.03; 72/407

[58] Field of Search ..... 72/38, 342, 407, 454, 72/455, 456, 700, 453.03, 453.04, 446; 100/214, 270, 271

[56] References Cited

U.S. PATENT DOCUMENTS

| | | | |
|---|---|---|---|
| 998,968 | 7/1911 | Klocke et al. | 72/453.04 |
| 2,731,140 | 1/1956 | May | 72/453.03 |
| 2,878,562 | 3/1959 | Bruce | 72/342 |
| 3,512,476 | 5/1970 | Georg | 72/454 X |
| 3,605,477 | 9/1971 | Carlson | 72/342 |
| 3,621,700 | 11/1971 | Wachtell et al. | 72/342 X |
| 3,789,689 | 2/1974 | Mace | 72/407 |
| 4,291,566 | 9/1981 | Dinsdale | 72/342 |

FOREIGN PATENT DOCUMENTS

| | | | |
|---|---|---|---|
| 556053 | 9/1977 | U.S.S.R. | 100/270 |

*Primary Examiner*—E. Michael Combs
*Attorney, Agent, or Firm*—Charles T. Silberberg

[57] ABSTRACT

An improved insulated forming press for forming structures at elevated temperatures and pressures is disclosed. Vertical rams move vertical heated platens, vertical ram insulation blocks, and vertically oriented forming dies, to close about a workpiece. The workpiece, insulation blocks, platens, and dies are supported by two sets of interlocking support members. One ram is activated by a plurality of mechanical jack screws, and the other is activated by a plurality of hydraulic cylinders that utilize a nonflammable mixture of water glycol. After forming is completed, the tooling can be automatically separated by retracting the rams and the workpiece is removed vertically.

21 Claims, 3 Drawing Figures

VERITCAL PRESS

BACKGROUND

The invention relates to the field of forming metal structures, and particularly to an apparatus for sealing tooling about vertically oriented, metal worksheets.

It is known that certain metals, such as titanium, and other alloys, exhibit superplasticity. Superplasticity is the capability of a material to develop unusually high tensile elongations with a reduced tendency towards necking. This capability is exhibited by only a limited number of metals and alloys, and within limited temperature and strain rate ranges.

Until the advent of viable superplastic forming techniques, taking advantage of this property to form complex configurations requiring large tensile elongations was extremely difficult, or in some instances, impossible. Simplified, the process involves placing a metal blank workpiece over a cavity in a die. The blank is heated to a temperature where it exhibits superplastic characteristics and a pressure differential is applied to the blank, causing it to stretch and form into the cavity. This process is disclosed in U.S. Pat. No. 3,934,441, "Controlled Environment Superplastic Forming of Metals", by Hamilton et. al. and is herein incorporated by reference.

Diffusion bonding refers to the metallurgical joining of surfaces of similar or dissimilar metals by applying heat and pressure for a sufficient time so as to cause commingling of the atoms at the joint interface. Diffusion bonding is accomplished entirely in the solid state, at or above one-half the base metal melting point. Actual times, temperatures and pressures will vary from metal to metal.

The combining of superplastic forming and diffusion bonding in the making of metallic sandwich structures has been successfully accomplished and is disclosed in U.S. Pat. No. 3,927,817, "Method of Making Metallic Sandwich Structures", by Hamilton, et. al., and is herein incorporated by reference.

Basically, the method for making metallic sandwich structures involves fabricating the structures from a stack of metal worksheets. Typically, the necessary tooling is incorporated within a hydraulic press. One or more of the sheets are coated in the selected areas not to be diffusion bonded. The sheets are positioned in a stacked relationship and are placed in a die assembly, wherein the stack is constrained at its periphery forming a seal thereabout. The sheets are diffusion bonded together in the uncoated areas by the controlled application of temperature and pressure, and at least one of the sheets is superplastically formed against one or more of the die surfaces, thereby forming the sandwich structure. The core configuration is determined by the location, size, and shape of the joined areas.

When the press is in continuous production, the metal structure is hot loaded and unloaded to avoid time consuming cooldown and reheat cycles. However, hot loading and unloading is extremely dangerous when performed manually from a press having horizontal rams. Also, removal of the hot part from a standard press often results in distortion of the part.

It is difficult to make a formed part within narrow tolerance, since the dies expand during forming temperatures. Also, the forming pressures within the die typically vary throughout the forming cycle, causing distortions by virtue of inappropriate die pressure. For example, die pressure which is too high can cause flow forming of the constrained periphery of the part, while die pressure which is too low can cause the seal to be lost or slippage of the preform during forming. Thus, in the past, to be sure that the structure remained in tolerance, excessive clamping forces were applied, aggravating the flow forming problem.

In the Hamilton sandwich process, metal worksheets are selectively coated with a stop-off material, and are placed in a stack within an enclosure. The stack is sealed within the enclosure and effectively constrained from further movement. The sheets are diffusion bonded together in the contact areas by applying compressive inert gas pressure. The stack is inflated and superplastically formed into the final structure.

U.S. Pat. No. 4,306,436 entitled "Method and Apparatus for Regulating Preselected Loads on Forming Dies" by D. W. Schulz, et. al., is also incorporated herein by reference. It discloses a horizontal press that uses mechanical pressure and a pressure bladder to form workpieces by superplastic forming or superplastic forming and diffusion bonding. The pressure bladder acts as a vernier or a find-adjustment for the mechanical pressure. However, the fatigue life of the pressure bladder is a problem, as the bladder must be replaced after relatively few cycles. The problem is compounded by the difficulty involved in replacing the bladders.

What is needed is a heavy duty, vertical forming press that will operate at elevated pressures and temperatures, and will overcome the disadvantages of the prior art.

SUMMARY

The primary object of the present invention is to provide a press for sealing tooling about a workpiece that will allow for safer and easier hot loading and unloading of the workpiece.

Another object of the present invention is to minimize distortion, warpage, and buckling resulting from gravitational forces during hot unloading.

Yet another object of the present invention is to provide a press that can be utilized in the continuous production of superplastically formed and diffusion bonded parts.

The present invention is an improved press to be used in the manufacture of structures at elevated temperatures and pressures. Although the press has been specifically designed for high pressure superplastic forming, or diffusion bonding and superplastic forming of parts, the press can be used for sealing and securing the tooling in high pressure applications involving other types of structures.

The press utilizes two rams having vertical surfaces that seal a workpiece in a vertical orientation. The vertical design is critical and results in the elimination of the dangerous loading and unloading operations involving the lifting of the massive top portion of the press in a horizontal plane. This danger is aggravated when the press is operating at high temperatures. The vertical design is also effective in reducing workpiece distortion during unloading and cooldown. Since the hot workpiece is vertical during unloading, distortion caused by gravitational forces as the workpiece is removed is minimized. This is accomplished by holding the workpiece along the top edge so that the weight of the workpiece is evenly distributed, while the workpiece is cooling.

The use of vertical rams requires that the workpiece be supported during the pressing cycle. Although a flat, horizontal surface can be used, a novel support structure is preferred that serves to separate the forming dies, the heating platens, and the insulator blocks from the formed structure.

The support structure consists of two sets of interlocking support members, each set of which is connected to a vertical ram. Although the support members are substantially horizontal one set is elevated slightly above the other set.

The pressure applied to seal the tooling about the workpiece is a combination of mechanical pressure and hydraulic pressure and is preselected so as to create a seal between the two dies. The mechanical pressure is in the form of jackscrews which are initially used to bring the rams into close proximity to each other. Fluid pressure is then applied through a plurality of hydraulic cylinders affixed to one ram. The hydraulic cylinders are used to align the affixed vertical ram so as to apply uniform pressure to the tooling along the ram surface.

The fluid pressure is preferred to a pressure bladder for two reasons. First, the fluid pressure instrumentation has a longer life, thereby producing better repeatability and being better suited to a manufacturing environment. Second, fluid pressure devices are easier to maintain and replace than a pressure bladder. The fluid used is generally hydraulic, and a nonflammable water glycol solution is preferred.

Although the press can be used to form parts at ambient temperatures, superplastic forming occurs at elevated temperatures. When high temperatures are involved, insulator blocks may be used to minimize heat losses.

The novel features which are believed to be characteristic of the invention, both as to the apparatus and the forming proces, together with further objects and advantages thereof, will be better understood from the following description in connection with the accompanying drawings in which presently preferred embodiments of the invention are illustrated by way of examples.

It is to be expressly understood, however, that the drawings are for purposes of illustration and description only, and are not intended as a definition of the limits of the invention.

DETAILED DESCRIPTION OF THE INVENTION

Figure 1:
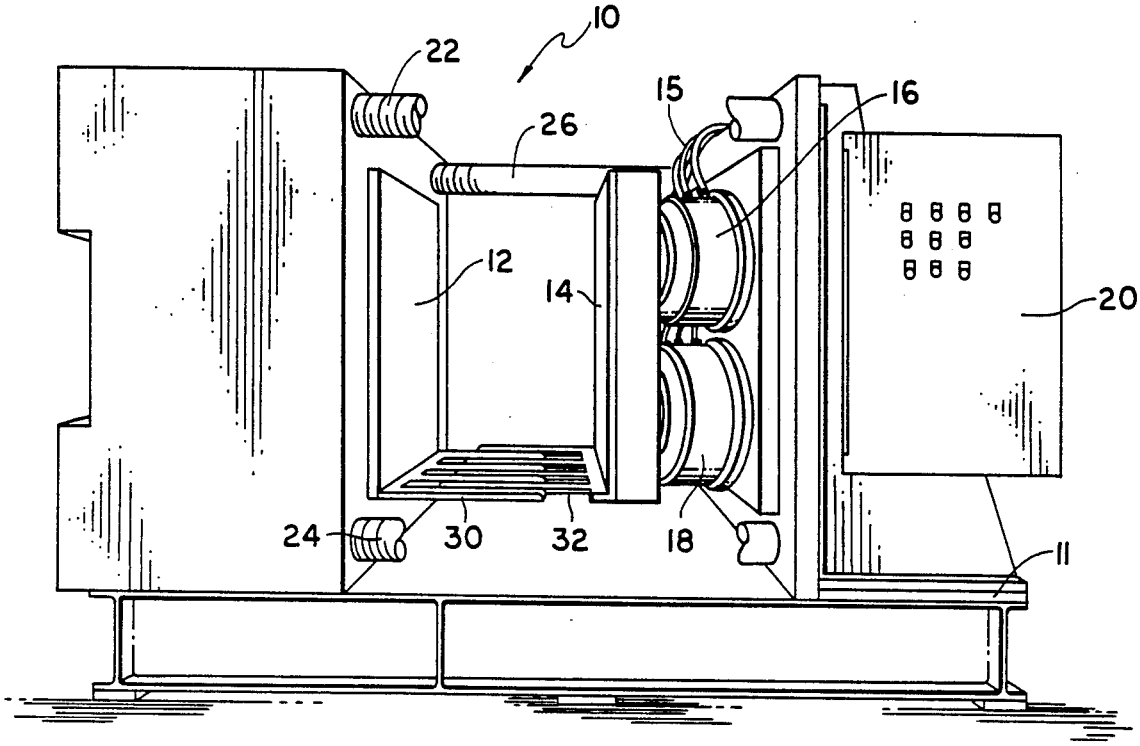
FIG. 1 is an isometric view of a vertical press according to the present invention.

Referring now to the drawings, there is shown in FIG. 1 an overall isometric view of a vertical forming press 10.

Press rams 12 and 14 are oriented in a vertical plane and may be mounted on shuttle tables which ride on roundway bearings (not shown) and supported by support frame 11. Ram 12 is powered by four, mechanical, jack screws 22, 24, 26, and 28 (only three of which are shown) that are located at each of the four corners of ram 12. Ram 12 moves towards ram 14 as the jack screws 22, 24, 26, and 28 are preferably rotated in a clockwise rotation. A control panel 20 is used to control the operation of press 10.

Ram 14 is activated by six pancake-type, hydraulic cylinders, aligned in two horizontal rows having three cylinders each (only two cylinders 16 and 18 are shown). Ram 14 only has a small stroke, preferably of about one inch. This small travel reduces the size of the hydraulic cylinders, the size of the hydraulic fluid storage tank, and the pump volume. Each cylinder has about a 14 inch diameter piston. When the press operates at lower pressures the two center cylinders (not shown) provide the travel for ram 14 whereas the four corner cylinders are used for orientation to align ram 14 with tooling 50 and 52 (see FIG. 2). The orientation process is necessary to assure application of uniform pressure to tooling 52. Since each cylinder applies essentially equal pressure to ram 14, when the four corner cylinders are used for orientation purposes, the total pressure capacity is reduced by about two-thirds. Fire resistant hydraulic fluid with a water-glycol base, provided by hydraulic lines 15 is used in the cylinders. The hydraulic power supply unit includes a low volume, high pressure pumping system. The pressure applied by ram 14 is also used to bury a seal (not shown) from the tooling into the workpiece. When small workpieces are to be formed in the apparatus, the four corner cylinders (only 16 and 18 are shown) may be deactivated, using only the center two cylinders to apply the hydraulic pressure.

Figure 2:
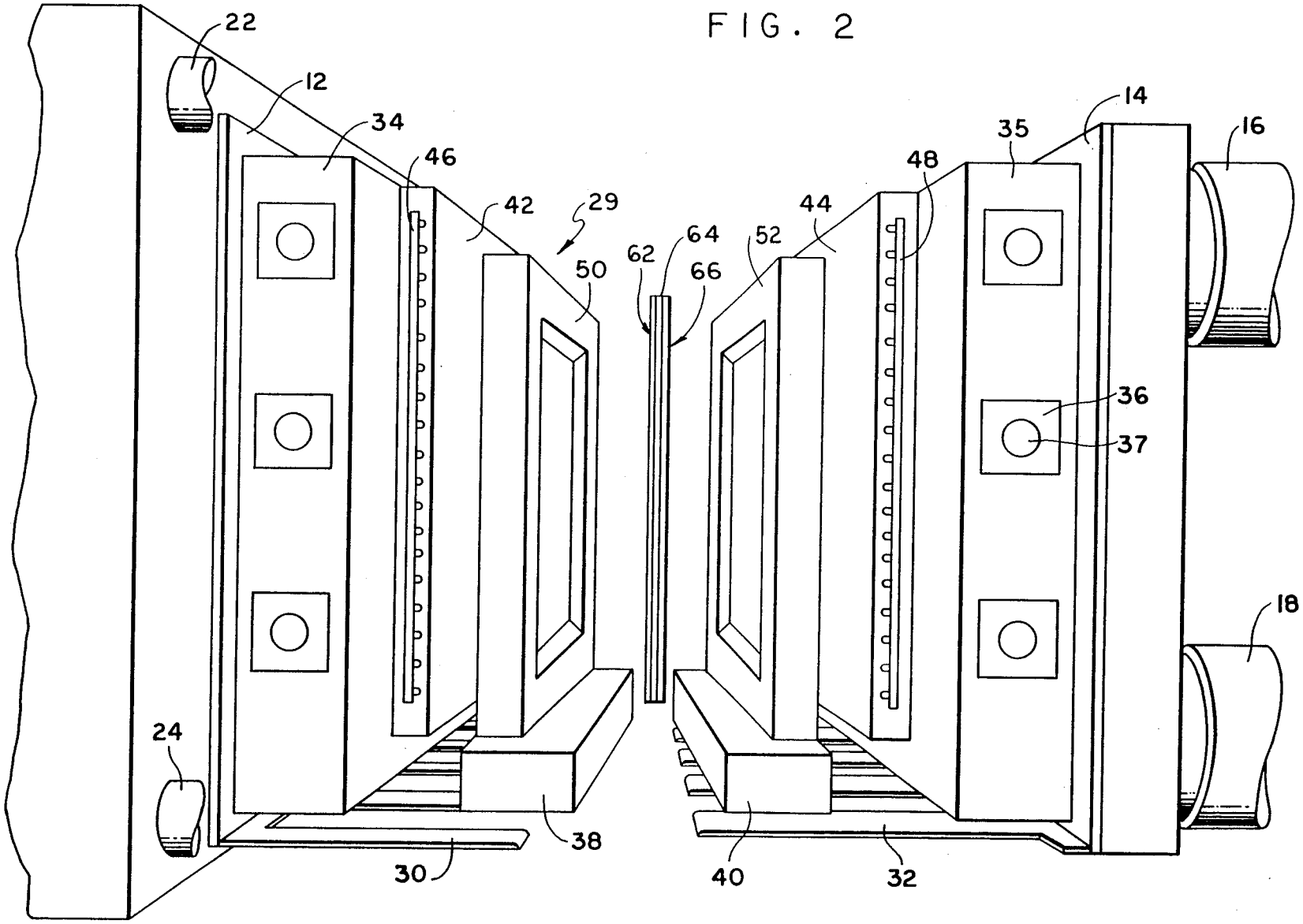
FIG. 2 is a fragmentary isometric view of the vertical press rams which also illustrates the tooling and worksheets.

FIG. 2 depicts two sets of interlocking support members 30 and 32, which support tooling 29 and worksheets 62, 64, and 66. A primary advantage of press 10 having vertical rams (as opposed to horizontal rams) is that it is not necessary to lift one tool segment, a heating element, and an insulator block weighing about 4000 pounds to load and unload workpieces materials. In press 10 tooling dies 50 and 52, heating platens 42 and 44, and ceramic insulators 34 and 35 slide horizontally when rams 12 and 14 separate.

Figure 3:
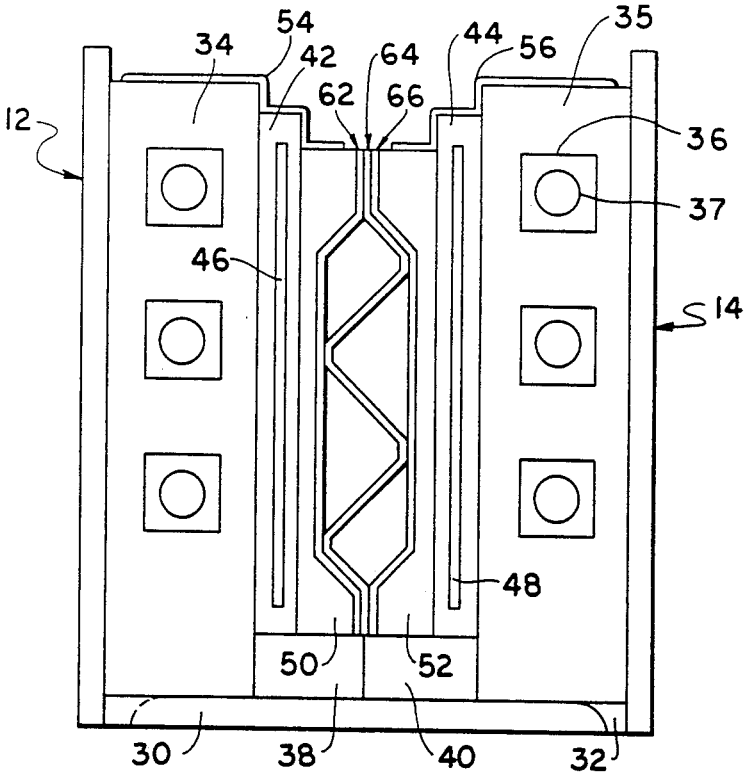
FIG. 3 is a fragmentary cross-sectional view of the closed tooling, showing a fully expanded sandwich structure after superplastic forming.

Although various support means may be used, in the preferred embodiment four, horizontal, ram support legs are attached to ram 12 and four, horizontal, support legs are attached to ram 14. The support legs intermesh to provide a segmented but solid base plate to support the tooling 29. Support member 30 is attached to ram 12, and is elevated, preferably about one-quarter inch over support member 32. This allows the tooling 50 supported by the higher support member 30 to automatically move with ram 12, while the worksheets 62, 64, 66 and tooling 52 are unaffected (equivalenty, the worksheets could move with tooling 50 away from tooling 52). This of course, greatly eases tool separation, allowing access to the worksheets without having to lift a hot insulator, heating platen, and upper die. Shims (not shown) are placed on lower support member 32 so that tooling cavity in tool 50 lines up with tooling cavity in tool 52. Support brackets (not shown) are attached to each set of support members 30 and 32 to prevent the tooling from tipping over and to separate the hot tooling. In addition, tooling brackets 54 and 56 may be attached to secure each insulator, heating platen, and die together (see FIG. 3).

Ceramic insulators 34 and 35 which are preferrably about eight to ten inches thick, are made from rebonded fused silica, and are commercially available from the Thermo Materials Corporation of Scottsdale, Georgia.

Each ceramic insulator is reinforced by seven reinforcing rods 37 (three in the horizontal direction and four in the vertical direction) that fit into holes drilled through the ceramic (only three are shown). Each rod is supported by two rectangular plate 36 (one at each end). The plates are secured to the rods by spring washers which preload the reinforcing rods to about 15,000 pounds tension. This rod matrix configuration allows the ceramic to withstand the large compressive and tensile forces applied through the ceramic. In addition, ceramic blocks 38 and 40 support the dies 50 and 52 and heating platens 42 and 44 to minimize heat loss in the downward direction. Also, wool insulation (not shown) may be inserted loosely around the sides and top of dies 50 and 52 to minimize heat losses.

Heat is applied to the tooling by two resistance heating platens 42 and 44 located between each ceramic and each die. The platens 42 and 44 contain heating elements 46 and 48 which consist of a wire element inserted into alumina insulators. Thermocouples (not shown) located within the platens 42 and 44 measure the temperature of the platens. The thermocouples are monitored by controllers (not shown) which automatically adjust power output to the heating elements 46 and 48 to control process forming temperatures.

The jack screws 22, 24, 26, and 28 close the press about the tooling leaving about a one-half inch gap. The hydraulic cylinders 16 and 18 close ram 14 to seal the tooling about worksheets 62, 64, and 66. Pressure is applied to worksheets 62, 64 and 66 to effect diffusion bonding. To superplastically form and diffusion bond 6V- Al titanium, heat is applied to the workpiece by heating platens 42 and 44 with the temperature raised to about 1650° F. During superplastic forming, an internal pressure differential of from 200 to 300 psi is applied depending upon the yield strength of the sheet material and the thickness of the sheet. The forming cycle may take from eight minutes to eighty-five minutes depending upon the amount of stretching required in the forming process. When the forming cycle is complete, the hydraulic cylinders 16 and 18 are retracted and the press is slightly opened. An overhead crane (not shown) seizes the formed part 65, rams 12 and 14 are fully separated, and the part removed and inserted into a protective hood (not shown) filled with argon gas. This environment will help control contamination as the formed part cools and is subsequently transferred to a cooling chamber (not shown). The next stack of worksheets are inserted into the hot press between the tooling and the cycle is repeated.

When the press is operated at ambient temperatures, heating platens 42 and 44, and ceramic insulators 34 and 36 are not needed. However, in most forming applications elevated temperatures are involved and the thermal efficiency of the press depends upon the quality of the heating platens 42 and 44 and the insulators 34 and 36.

Accordingly, there has been provided, in accordance with the invention, a forming apparatus and a forming method that fully satisfies the objectives set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

What is claimed is:

1. An apparatus for sealing tooling about a workpiece, which comprises:

two substantially rigid and vertical rams which oppose each other and are substantially parallel to each other, said rams being in a horizontally spaced relationship;

support means under said tooling and said workpiece for supporting said tooling and said workpiece between said vertical rams; and pressure means for moving said rams to vary said spaced relationship and clamp said tooling about said workpiece such that said tooling is sealed about said workpiece, said pressure means including a mechanical means for moving one ram and a fluid pressure means for moving the other ram, said one ram movable by said mechanical means having a substantially greater range of horizontal movement than said other ram which is movable by said fluid pressure means.

2. The apparatus of claim 1, further comprising a means positioned between said rams for heating said workpiece.

3. The apparatus of claim 1, wherein said pressure means employs a nonflammable water glycol solution.

4. The apparatus of claim 1, wherein said fluid pressure means selectively moves said other ram into a transverse orientation relative to said one ram so as to improve alignment with said tooling, whereby pressure can be applied more uniformly to said tooling.

5. The apparatus of claim 4, wherein said pressure means comprises a plurality of hydraulic cylinders attached to said other vertical ram.

6. The apparatus of claim 5, wherein pressure can be applied by said hydraulic cylinders differentially to effect said transverse orientation.

7. The apparatus of claim 6, wherein only a portion of said hydraulic cylinders are used to effect said transverse orientation.

8. The apparatus of claim 1, wherein said tooling rests on said support means.

9. The apparatus of claim 8, wherein said support means comprises two intermeshing support members, each of said support members comprising a plurality of substantially parallel spaced legs.

10. The apparatus of claim 8, wherein said support means is horizontally disposed and said workpiece and said tooling are positioned vertically.

11. The apparatus of claim 9, wherein said support means is horizontally disposed and said workpiece and said tooling are positioned vertically.

12. The apparatus of claim 11, wherein said tooling comprises two tooling members, one of said tooling members resting on one of said support members, and the other tooling member resting on the other support member.

13. The apparatus of claim 8, wherein said support means comprises two support members, each of said support members respectively attached to one of said vertical rams, and wherein said tooling comprises two tooling members, one of said tooling members resting on one of said support members, the other tooling member resting on the other support member, said workpiece positioned between said tooling members, said workpiece and said tooling members positioned vertically, whereby said workpiece can be vertically inserted and removed from between said tooling members when said tooling members are separated from each other by virtue of the horizontal positioning of said rams.

14. The apparatus of claim 12, wherein each of said support members is respectively attached to one of said vertical rams, said workpiece is positioned between said tooling members, whereby said workpiece can be vertically inserted and removed from between said tooling members when said tooling members are separated from each other by virtue of the horizontal positioning of said rams.

15. The apparatus of claim 8, wherein said support means comprises two intermeshing support members, and one of said support members is elevated relative to the other support member.

16. The apparatus of claim 14, wherein one of said support members is elevated relative to the other support member.

17. An apparatus for sealing tooling about a workpiece, which comprises:

two substantially rigid and vertical rams which oppose each other and are substantially parallel to each other, said rams being in horizontally spaced relationship;

support means for supporting said tooling and said workpiece between said rams, said support means being under said tooling and workpiece and between said rams, said tooling resting on said support means, said support means comprising two support members, each of said support members respectively attached to one of said vertical rams, said tooling comprising two tooling members, one of said tooling members resting on one of said support members, the other tooling member resting on the other support member, said workpiece being positioned between said tooling members, said workpiece and said tooling members positioned vertically; and pressure means for moving said rams to vary said spaced relationship and clamp said tooling about said workpiece such that said tooling is sealed about said workpiece, whereby said workpiece can be vertically inserted and removed from between said tooling members when said tooling members are separated from each other by virtue of the horizontal positioning of said rams.

18. The apparatus of claim 17, wherein said support members are intermeshing when said tooling is sealed about said workpiece.

19. The apparatus of claim 18, wherein each of said support members comprises a plurality of substantially parallel spaced legs.

20. The apparatus of claim 18, wherein one of said support members is elevated relative to the other support member.

21. The apparatus of claim 19, wherein one of said support members is elevated relative to the other support member.

* * * * *